US009818502B1

(12) United States Patent
Petrucci et al.

(10) Patent No.: US 9,818,502 B1
(45) Date of Patent: Nov. 14, 2017

(54) COMMONIZED ELECTRICAL GROUNDING DEVICE

(71) Applicant: GM GLOBAL TECHNOLOGY OPERATIONS LLC, Detroit, MI (US)

(72) Inventors: David R Petrucci, Warren, MI (US); Harpal Singh, Rochester, MI (US); Louis Meli, Sterling Heights, MI (US); Ahmed Khan, Troy, MI (US); William A Schumacher, South Lyon, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 0 days.

(21) Appl. No.: 15/235,919

(22) Filed: Aug. 12, 2016

(51) Int. Cl.
*H01B 5/02* (2006.01)
*H01R 4/62* (2006.01)
*H01R 4/64* (2006.01)

(52) U.S. Cl.
CPC ..... *H01B 5/02* (2013.01); *H01R 4/62* (2013.01); *H01R 4/64* (2013.01); *H01R 2201/26* (2013.01)

(58) Field of Classification Search
CPC .. H01R 2201/26; H01R 13/6205; H01R 4/64; H01R 11/12
See application file for complete search history.

(56) References Cited

U.S. PATENT DOCUMENTS 5,087,206 A * 2/1992 Jaenke ..... H01R 13/523 439/433
5,326,273 A * 7/1994 Kamon ..... H01R 4/62 174/94 R
5,928,006 A * 7/1999 Franks, Jr. ..... H01R 4/36 439/443
7,083,479 B2 * 8/2006 Muller ..... H01R 4/64 439/801
7,363,683 B2 * 4/2008 Wagner ..... G02C 5/2236 16/228
7,896,712 B2 * 3/2011 Cecil ..... H01R 4/20 439/523
2011/0085875 A1 * 4/2011 Aftanas ..... F16B 7/187 411/347
2012/0270425 A1 * 10/2012 Rae ..... B23K 31/02 439/92
2015/0087176 A1 * 3/2015 Arriola ..... H01R 13/28 439/312

* cited by examiner

*Primary Examiner* — Amy Cohen Johnson
*Assistant Examiner* — Oscar C Jimenez

(57) ABSTRACT

A grounding element is provided. The grounding element includes a first portion including a first metal; a second portion including a second metal other than the first metal; and a fastening portion configured to receive a fastener to attach the grounding element to a body. The grounding element may be welded to a body of a vehicle and used to ground a vehicle electrical system.

19 Claims, 4 Drawing Sheets

COMMONIZED ELECTRICAL GROUNDING DEVICE

Apparatuses and systems consistent with exemplary embodiments relate to electrical grounding devices. More particularly, apparatuses consistent with exemplary embodiments relate to multi-element electrical grounding devices capable of acting as a grounding terminal.

SUMMARY

One or more exemplary embodiments provide a grounding element. More particularly, one or more exemplary embodiments provide a grounding element comprising two metals.

According to an aspect of an exemplary embodiment, a grounding element for a vehicle frame is provided. The grounding element includes: a first portion comprising a first metal; a second portion comprising a second metal other than the first metal; and a fastening portion configured to receive a fastener to attach the grounding element to the vehicle frame.

According to an aspect of an exemplary embodiment, a grounding element is provided, the grounding element includes: a first portion comprising a first metal; a second portion comprising a second metal other than the first metal; a fastening portion configured to receive a fastener to attach the grounding element to a frame.

The first metal may include aluminum and the second metal may include steel.

The fastening portion may include a channel formed through the first portion and the second portion.

The channel may include a cylindrical shape.

The grounding element may further include a sloped portion between the channel and at least one of a face of the first portion and a face of the second portion.

The grounding element may further include a sealing portion disposed between the first portion and the second portion, the sealing portion configured to seal the first portion from the second portion.

The grounding element may further include a third portion comprising a third metal other than the second metal and the first metal, The third portion may include at least one flap that extends beyond a radius of the first portion and the second portion, at least one perpendicular panel that extends perpendicularly from an end of the at least one flap, and an attachment portion that is parallel to the at least one flap and that extends perpendicularly from an end of the at least one perpendicular panel.

The third portion may be disposed in between the first portion and the second portion.

The grounding element may further include a welding projection disposed on a face of at least one of the first portion and the second portion.

The grounding element may further include a channel along a base of the welding projection.

The welding projection may include a first plurality of welding projections, the first plurality of welding projections formed at equidistant locations along a face of the first portion.

The welding projection further comprises a second plurality of welding projections, the second plurality of welding projections formed at equidistant locations along a face of the second portion.

The grounding element may further include a plurality of first channels formed along bases of the first plurality of welding projections.

The grounding element may further include a plurality of second channels formed along bases of the second plurality of welding projections.

The welding projection may include a semi-spherical shape.

The welding projection may further include a flat surface on a top portion of the semi-spherical shape.

The at least one of the first portion and the second portion may include a cylindrical shape.

The grounding element may further include comprising a sloped portion formed along an outer edge of a face of at least one of the first portion and the second portion.

A back side of the first portion and a back side of the second portion may be connected together, and a front of the first portion and a front of the second portion face opposite directions.

According to an aspect of another exemplary embodiment, a grounding element is provided. The grounding element includes: a first portion comprising a first metal; a second portion comprising a second metal other than the first metal; and a fastening portion configured to receive a fastener to attach the grounding element to a frame from a first direction such that the first portion faces away from the frame and receive a fastener to attach the grounding element to the frame from a second direction such that the second portion faces away from the frame.

Other objects, advantages and novel features of the exemplary embodiments will become more apparent from the following detailed description of exemplary embodiments and the accompanying drawings.

DETAILED DESCRIPTION

Figure 1:
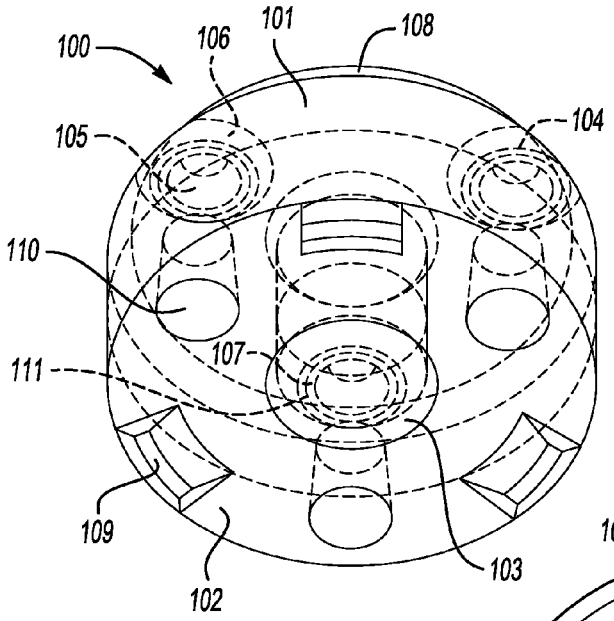
FIG. 1 shows a perspective view of a grounding element according to an exemplary embodiment.

Grounding elements are used to ground electrical systems. One application of a grounding element is to ground electrical systems of a vehicle. As new materials are being used to construct lighter and more fuel efficient vehicles, there is a need for new types of grounding elements that have the versatility to be used on different vehicle materials.

A grounding element will now be described in detail with reference to FIGS. 1-6 of the accompanying drawings in which like reference numerals refer to like elements throughout. The following disclosure will enable one skilled in the art to practice the inventive concept. However, the exemplary embodiments disclosed herein are merely exemplary and do not limit the inventive concept to exemplary embodiments described herein. Moreover, descriptions of features or aspects of each exemplary embodiment should typically be considered as available for aspects of other exemplary embodiments.

It is also understood that where it is stated herein that a first element is "connected to," "formed on," or "disposed on" a second element, the first element may be connected directly to, formed directly on or disposed directly on the second element or there may be intervening elements between the first element and the second element unless it is stated that a first element is "directly" connected to, formed on, or disposed on the second element.

FIG. 1 shows a perspective view of a grounding element 100 according to an exemplary embodiment. Referring to FIG. 1, the grounding element 100 includes a first portion 101 and a second portion 102. The first portion 101 and the second portion 102 may be formed of or comprise a first metal and a second metal, respectively. For example, the first portion may comprise steel and the second portion may comprise aluminum, or vice versa. The face of the first portion 101 and the face of the second portion 102 face away from each other or in opposite directions. In one example, the first portion 101 and the second portion 102 may also comprise a first color and a second color, respectively, so as to distinguish the first portion 101 from the second portion 102.

Moreover, a center channel 103 may perpendicularly intersect through a center of the first portion 101 and the second portion 102. The center channel 103 may be cylindrical in shape and may include threads 111. The center channel 103 may be configured to receive an m6 bolt, screw or other fastener to attach the grounding element 100 to body such as a body of a vehicle. However, the center channel 103 is not limited to aforementioned configuration.

The first portion 101 may include a plurality of first protrusions 104 on the face of the first portion 101. Each of the plurality of first protrusions 104 may be semi-spherical in shape and may include a flat portion 105 on a top part the protrusion. A groove 106 (i.e., a channel, indentation, depression, etc.) may be formed around a circumference of a base of each of the plurality of first protrusions 104. The plurality of first protrusions 104 may include 3 or more protrusions configured as contacts point for welding the first portion 101 to a body. The plurality of first protrusions 104 may be spaced 120 degrees apart or at equidistant points across the face of the first portion 101. A first sloped portion 107 may be formed between a face of the first portion 101 and the center channel 103. A crown or second sloped portion 108 may be formed around a circumference of a face the first portion 101. The plurality of first protrusions 104 may also be shaped as blades, fins, wedges, cones, semi-spheres, etc.

The second portion 102 may include a plurality of second protrusions 109. The plurality of second protrusions 109 may have a fixed length and height, and may also have a decreasing width from a base to the top thereof. The plurality of second protrusions 109 may also be shaped as blades, fins, wedges, cones, semi-spheres, etc. The differences between shapes of the plurality of first protrusions 104 and the plurality of second protrusions 109 may allow a vibratory feed system to distinguish the first portion 101 from the second portion 102. In particular, error proofing may be accomplished by use of vibration with physical differences on each side of the grounding element 100, electromagnet sorting, and/or color.

The second portion 102 may further include a plurality of indentations 110 or recesses. The plurality of indentations 110 may be cut through the second portion 102 reaching up to a back side of the first portion 101. Alternatively, the plurality of indentations 110 may be cut through the first portion 101 reaching up to a back side of the second portion 102. The plurality of indentations 110 may run along the same axis's as on a plurality of protrusions on an opposite face of the grounding element 100. In other words, the plurality of indentations 110 may be formed or cut behind the plurality of first protrusions 104. Alternatively, the plurality of indentations 110 may be offset from the plurality of first protrusions 104 on an opposite face of the grounding element 100.

The plurality of indentations 110 or holes may be offset from the projections and are created on each side of grounding element 100 to be used in manufacturing of the grounding element 100. For example, they may form offset nibs with respect to an opposite surface of the grounding element 100. They may also be useful during the assembly process to hold to a panel during the welding process. The plurality of indentations 110 or holes may also serve as a cooling feature during welding.

The plurality of indentations may be configured to receive a tool which holds the grounding element 100 in place. In particular, the plurality of indentations 110 may be configured to act as guides so that the grounding element 100 may be properly held by an appropriate tool on a correct side and properly welded to a body. Moreover, the plurality of indentations 110 may provide cooling to the grounding element 100. Alternatively, a plurality of through-holes that run through the first portion 101 and the second portion 102 may replace the plurality of indentations 110. The plurality of through-holes may also provide a cooling benefit when welding. For example, when welding the grounding element 100 using a resistance welding or an arc welding method.

According to an exemplary embodiment, a plurality of the grounding element 100 may be attached to each other as one unit to serve as a cluster for multiple connections. In addition, the grounding element 100 may shaped in different shapes such as squares, rectangles, etc. Further still, a plurality of the grounding element 100 may be attached to each other to form a strip of grounding elements 100 with a strap at each end. The grounding element 100 may be welded or attached to two dissimilar metal panels. Moreover, a stud may pass thru the grounding element and protrude on each side of the dissimilar metal panels so as to attach the panel electrically or mechanically, by use of a fastener.

Figure 2:
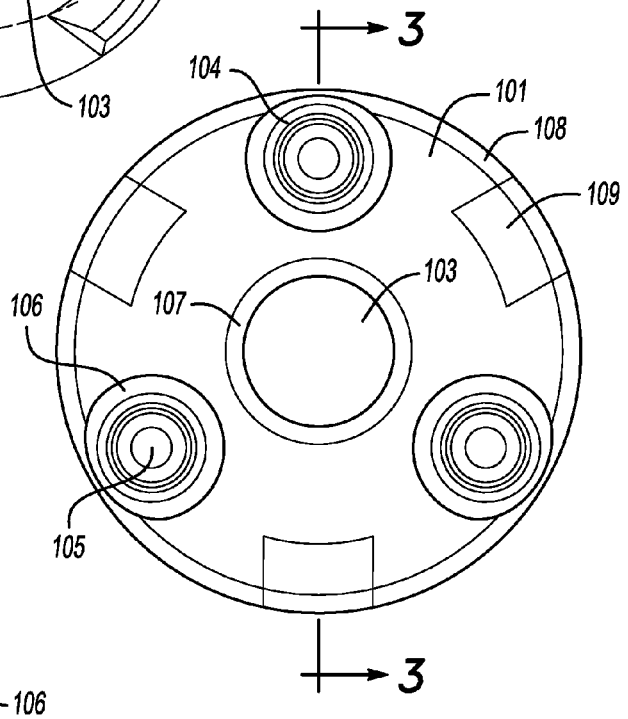
FIG. 2 shows a top view of a grounding element according to an aspect of an exemplary embodiment.

FIG. 2 shows a top view of a grounding element 100 according to an aspect of an exemplary embodiment. Referring to FIG. 2, a plurality of first protrusions 104 are located on the face of the first portion 101. Grooves 106 are disposed around a base of a circumference of each of the plurality of first protrusions 104. A first sloped portion 107 may be formed between a face of the first portion 101 and the center channel 103. In addition, outlines show the plurality of second protrusions 109, which may be formed on the second portion 102 opposite the face of the first portion 101. The plurality of second protrusions 109 may be formed at positions on a face of the second portion 102 in positions offset from the axis's of the plurality of first protrusions 104, which are located on the first portion 101.

Figure 3:
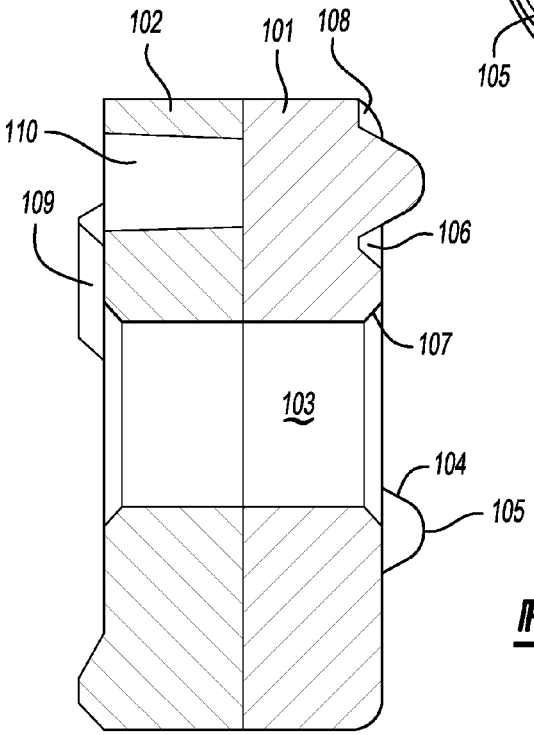
FIG. 3 shows a cross-sectional view of a grounding element according to an aspect of an exemplary embodiment.

FIG. 3 shows a cross-sectional view of a grounding element 100 along line A-A of FIG. 2, according to an aspect of an exemplary embodiment. Referring to FIG. 3, the grounding element 100 includes a plurality of first protrusions 104 are located on the face of the first portion 101. Grooves 106 are disposed around each of the plurality of first protrusions 104. A first sloped portion 107 may be formed between a face of the first portion 101 and the center channel 103 and a face of the second portion 102 and the center channel 103. In addition, the plurality of second protrusions 109 may be formed on the second portion 102 opposite the face of the first portion 101. Moreover, indentations 110 may formed in the second portion 10.

Figure 4A:
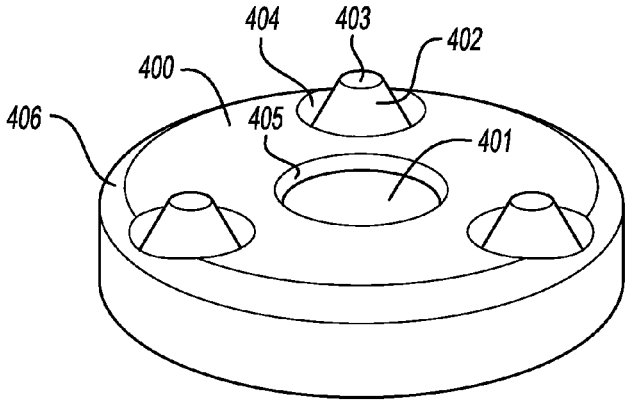
FIGS. 4A-4C show views of a first portion of a grounding element according to an aspect of another exemplary embodiment.
Figure 4B:
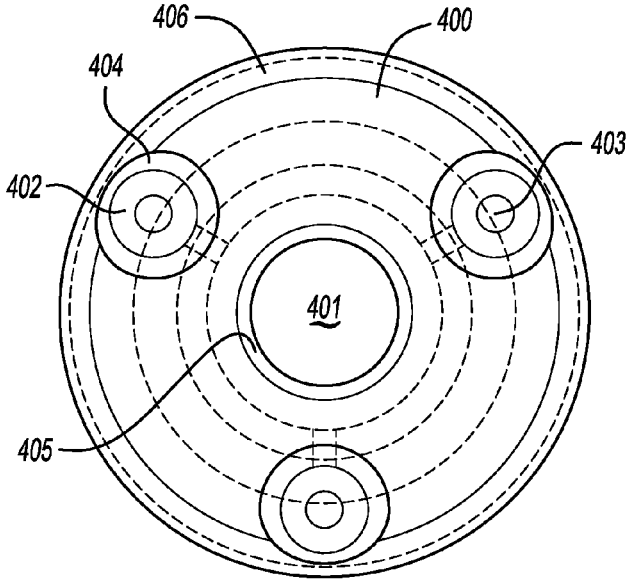
Figure 4C:
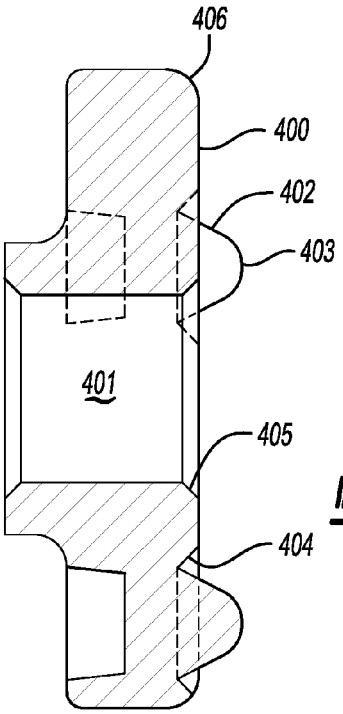

FIGS. 4A-4C show views of a first portion 400 for a grounding element according to an aspect of another exemplary embodiment. FIG. 4A shows a perspective view of a first portion 400. The first portion 400 includes a center channel 401, a plurality of first protrusions 402, flat portions 403 on tops of the plurality of first protrusions 402, grooves 404 around circumferences of the plurality of first protrusions 402, a first sloped portion 405 which slopes from the face of the first portion 400 into the second channel, and a second sloped portion 406 which wraps around a circumference of the face of the first portion 400. The first portion 400 is similar to the first portion 101 except that the plurality of first protrusions 402 are have a conical shape, whereas the plurality of first protrusions 104 of FIG. 1 are spherical in shape. Referring to FIG. 4B, a top view of the first portion 400 is shown. Referring to FIG. 4C, a cross sectional view of the first portion 400 is shown across line A-A of FIG. 4B.

Figure 5A:
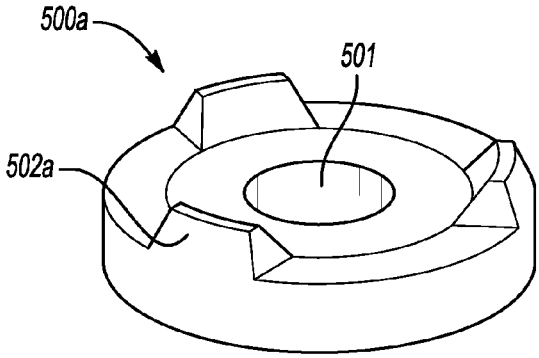
FIGS. 5A-5D show views of second portions of a grounding element according to various aspects of exemplary embodiments.

FIGS. 5A-5D show perspective views of second portions for grounding element according to various aspects of exemplary embodiments. FIG. 5A shows a perspective view of a second portion 500*a* of a grounding element according to an aspect of another exemplar embodiment. The second portion 500*a* includes a center channel 501 and a plurality of second protrusions 502*a*. In this case the plurality of second protrusions 502*a* are fin or wedged shape.

Figure 5B:
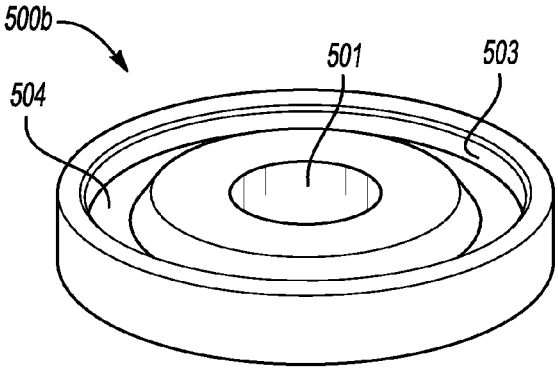

Referring to FIG. 5B, a perspective view of the second portion 500*b* of a grounding element according to an aspect of another exemplary embodiment is shown. The second portion 500*b* includes a center channel 501 and a circular groove 503 or indentation. The circular groove 503 forms a lip 504 around the circumference of the second metal part 500*b*.

Figure 5C:
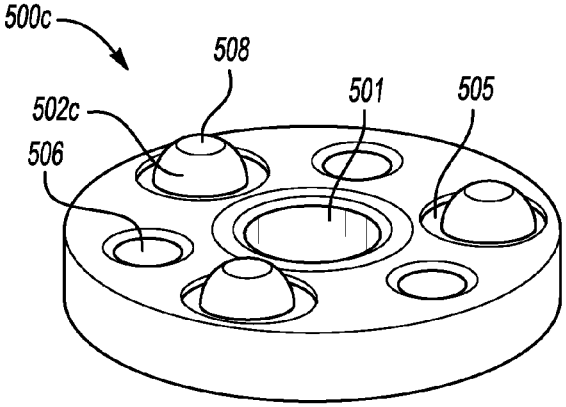

Referring to FIG. 5C, a perspective view of the second portion 500*c* of a grounding element according to an aspect of another exemplary embodiment is shown. The second portion 500*c* includes a center channel 501, semi-spherical protrusions 502*c* with flat tops 508, circular grooves 505 around circumferences of the bases of the semi-spherical protrusions 502*c*, guide/cooling holes 506.

Figure 5D:
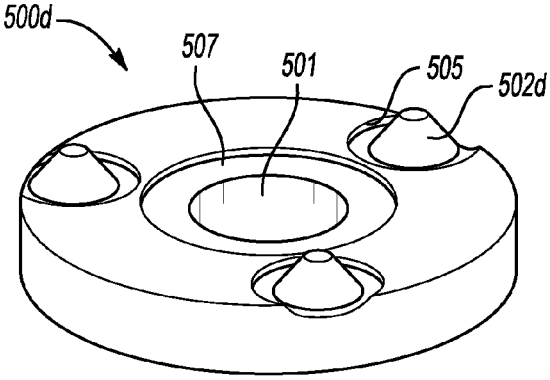

Referring to FIG. 5D, a perspective view of the second portion 500*d* of a grounding element according to an aspect of another exemplar embodiment is shown. The second portion 500*d* includes a center channel 501, conical protrusions 502*d*, circular grooves 505 around a circumference of the bases of the conical protrusions 502*d*, recessed area 507 around the center channel 501.

Figure 6:
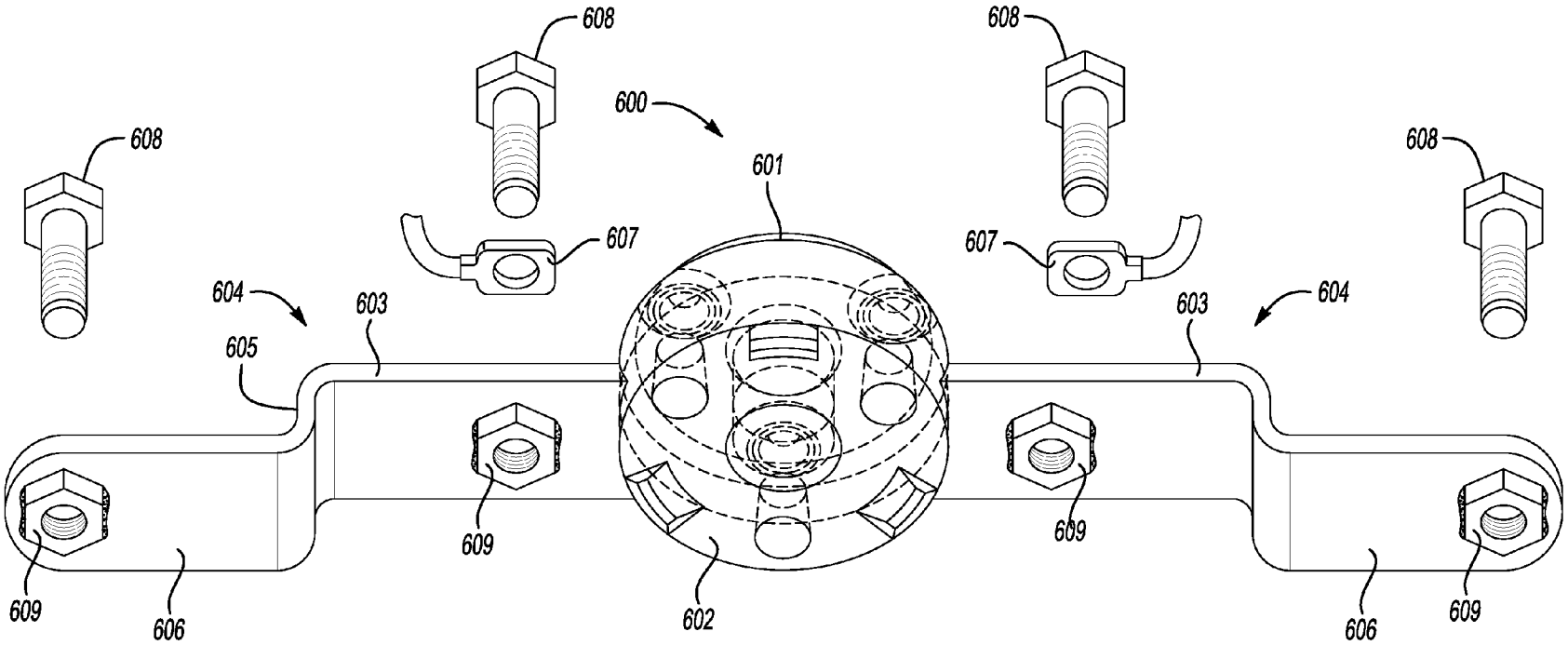
FIG. 6 shows a perspective view of a grounding element according to an aspect of another exemplary embodiment.

FIG. 6 shows a perspective view of a grounding element 600 according to an aspect of another exemplary embodiment. Referring to FIG. 6, the grounding element 600 may include a first portion 601, a second portion 602, and a third portion 604. The first portion 601 is similar to the first portion 101 and the second portion 602 is similar to the second portion 102 described with reference to FIG. 1 above.

The third portion 604 may be disposed between the first portion 601 and the second portion 602 and may include a metal that differs from the metal of the first portion 601 and the metal of the second portion 602. The third portion 604 may be disposed at ends of a strip of squared grounding elements 100. The third portion may include flaps 603 that extend beyond a radius, a width or a length of the first portion 601 and the second portion 602. The flaps 603 may intersect an axis that runs through the center of the first portion 601 and the second portion 602. The third portion 604 may include two perpendicular panels 605 that are perpendicular to flaps 603 and that respectively extend from flaps 603. In addition, the third portion 604 may also include attachment portions 606 that extend perpendicularly from the perpendicular panels 605. The attachment portions 606 may be used to attach the grounding element 600 to a body by welding or other fastening method (e.g., a screw, bolt, adhesive, etc.).

Although the exemplary embodiment shown in FIG. 6 shows two flaps 603, two perpendicular panels 605, and two attachment portions 606. The number of flaps 603 perpendicular panels 605, and attachment portions 606 may be one or more depending on the application or the required number of attachment points to a body.

The flaps 603 may include weld nuts or lug 609 and bolts 608 that are configured to receive and secure a ground wire 607. Moreover, the attachment portions 606 my include bolts 608 and weld nuts 609 to attach the attachment portions to a body. The bolts 608 and weld nuts 609 may tie third portion 604 electrically and mechanically to a metal structure.

One or more exemplary embodiments have been described above with reference to the drawings. The exemplary embodiments described above should be considered in a descriptive sense only and not for purposes of limitation. Moreover, the exemplary embodiments may be modified without departing from the spirit and scope of the inventive concept, which is defined by the following claims.

What is claimed is:

1. A grounding element for a vehicle frame, the grounding element comprising:

a first portion comprising a first metal;

a second portion comprising a second metal other than the first metal;

a fastening portion comprising a channel formed through the first portion and the second portion, the channel configured to receive a fastener to attach the grounding element to the vehicle frame;

a welding projection disposed on a face of the first portion;

an indentation disposed in the second portion opposite the welding projection; and a second channel along a base of the welding projection.

2. The grounding element of claim 1, wherein the indentation is aligned on a same axis as the welding projection.

3. The grounding element of claim 2, wherein the welding projection comprises a plurality of welding projections, and wherein the indentation comprises a plurality of indentations respectively formed on axis' of the plurality of welding projections.

4. A grounding element, the grounding element comprising:

a first portion comprising a first metal;

a second portion comprising a second metal other than the first metal;

a fastening portion comprising a channel formed through the first portion and the second portion, the channel configured to receive a fastener to attach the grounding element to a frame;

a welding projection disposed on a face of the first portion;

a protrusion disposed on a face of the second portion; and a second channel along a base of the welding projection.

5. The grounding element of claim 4, wherein the first metal comprises aluminum and the second metal comprises steel.

6. The grounding element of claim 4, wherein the channel comprises a cylindrical shape.

7. The grounding element of claim 6, further comprising a sloped portion between the channel and at least one of a face of the first portion and a face of the second portion.

8. The grounding element of claim 4, further comprising:

a third portion comprising a third metal other than the second metal and the first metal, wherein the third portion comprises at least one flap that extends beyond a radius of the first portion and the second portion, at least one perpendicular panel that extends perpendicularly from an end of the at least one flap, and an attachment portion that is parallel to the at least one flap and that extends perpendicularly from an end of the at least one perpendicular panel, and wherein the third portion is disposed in between the first portion and the second portion.

9. The grounding element of claim 4, wherein the welding projection comprises a first plurality of welding projections, the first plurality of welding projections formed at equidistant locations along a face of the first portion.

10. The grounding element of claim 9, wherein the protrusion further comprises a plurality of protrusions, the plurality of protrusions formed at equidistant locations along a face of the second portion.

11. The grounding element of claim 10, wherein the second channel comprises a plurality of first channels formed along bases of the first plurality of welding projections.

12. The grounding element of claim 4, wherein at least one of the first portion and the second portion comprises a cylindrical shape.

13. The grounding element of claim 4, further comprising a sloped portion formed along an outer edge of a face of at least one of the first portion and the second portion.

14. The grounding element of claim 4, wherein a back side of the first portion and a back side of the second portion are connected together, and a front of the first portion and a front of the second portion face opposite directions.

15. The grounding element of claim 4, wherein the protrusion is offset from the welding projection.

16. The grounding element of claim 15, wherein the welding projection comprises a plurality of welding projections, wherein the protrusion comprises a plurality of protrusions offset from the plurality of welding projections.

17. A grounding element, the grounding element comprising:

a first portion comprising a first metal;

a second portion comprising a second metal other than the first metal; and a fastening portion comprising a channel formed through the first portion and the second portion, the channel configured to receive a fastener to attach the grounding element to a frame from a first direction such that the first portion faces away from the frame and receive a fastener to attach the grounding element to the frame from a second direction such that the second portion faces away from the frame;

a welding projection disposed on a face of the first portion;

an indentation disposed in the second portion opposite the welding projection; and a second channel along a base of the welding projection.

18. The grounding element of claim 17, wherein the indentation is aligned on a same axis as the welding projection.

19. The grounding element of claim 18, wherein the welding projection comprises a plurality of welding projections, and wherein the indentation comprises a plurality of indentations respectively formed on axis' of the plurality of welding projections.

* * * * *